US011284677B2

(12) United States Patent
Doan et al.

(10) Patent No.: US 11,284,677 B2
(45) Date of Patent: Mar. 29, 2022

(54) DEVICE FOR OPENING AND CLOSING AN ARTICLE, IN PARTICULAR OF NATURAL OR ARTIFICIAL LEATHER, AND AN ARTICLE COMPRISING SUCH A DEVICE

(71) Applicant: HERMES SELLIER, Paris (FR)

(72) Inventors: Truong Vu Doan, Ivry sur Seine (FR); Camille Rouzaud, Levallois-Perret (FR)

(73) Assignee: HERMES SELLIER, Paris (FR)

( * ) Notice: Subject to any disclaimer, the term of this patent is extended or adjusted under 35 U.S.C. 154(b) by 92 days.

(21) Appl. No.: 16/851,900

(22) Filed: Apr. 17, 2020

(65) Prior Publication Data

US 2020/0329823 A1 Oct. 22, 2020

(30) Foreign Application Priority Data

Apr. 19, 2019 (FR) ..... 1904201

(51) Int. Cl.
*A44B 1/38* (2006.01)

(52) U.S. Cl.
CPC ..... *A44B 1/38* (2013.01)

(58) Field of Classification Search
CPC ... A44B 1/38; A44B 17/0023; A44B 17/0011; A44B 17/0041; A45C 13/126; A45C 13/12; A45C 13/123; E05B 65/5261; E05B 65/5253; E05B 65/48
See application file for complete search history.

(56) References Cited

U.S. PATENT DOCUMENTS 1,735,620 A * 11/1929 Salley ..... A44B 17/0011 24/110
2,124,975 A * 7/1938 Hojnowski ..... A44B 1/38 24/100.5
2,527,202 A 10/1950 Thiele
5,894,641 A * 4/1999 Hurtz ..... A44B 17/0011 24/658
9,504,294 B2 * 11/2016 Hasegawa ..... A44B 17/0076
2016/0261695 A1 * 9/2016 Schaff ..... A45C 13/10

FOREIGN PATENT DOCUMENTS

DE 1532879 A1 4/1969

OTHER PUBLICATIONS

Search Report, dated Jan. 9, 2020, from FR application No. 1904201.

* cited by examiner

*Primary Examiner* — Robert Sandy
*Assistant Examiner* — Louis A Mercado
(74) *Attorney, Agent, or Firm* — Nixon & Vanderhye

(57) ABSTRACT

A device for opening/closing an article includes an assembly button and a clasp casing with a mechanism including a housing, locking member and latch; the mechanism structured so with the housing in a first position and the button is inserted into the casing, the locking member immobilizes the button at least with respect to translation, when the housing is made to rotate and passes from its first to a second position, the member is moved until the button is released and the latch is driven with translational movement into the casing until the button is pushed out of the casing and the housing and the member are immobilized, when the button is reinserted into the casing, it pushes the latch which releases the housing, which is rotated and passes from its second to first position and the member is moved until the button is immobilized with respect to translation.

20 Claims, 14 Drawing Sheets

Fig.1
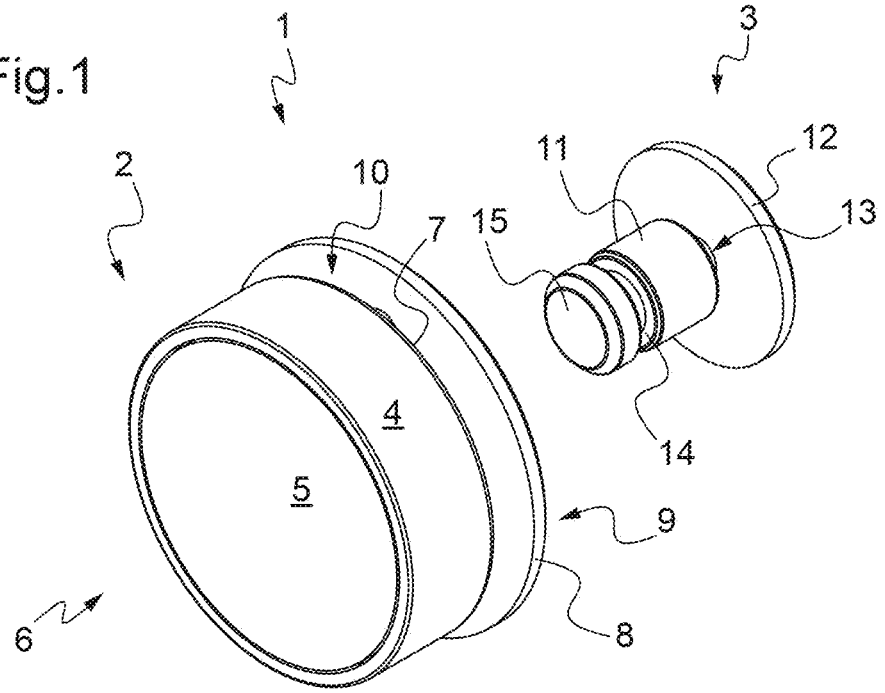
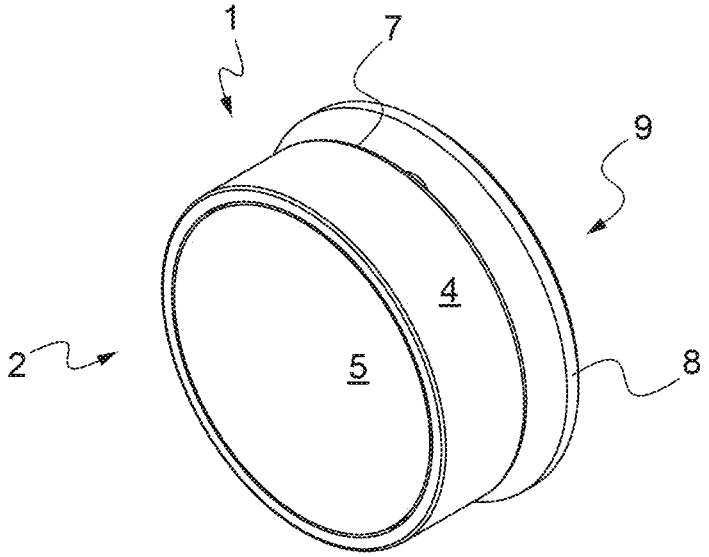
Fig.2

Fig.14
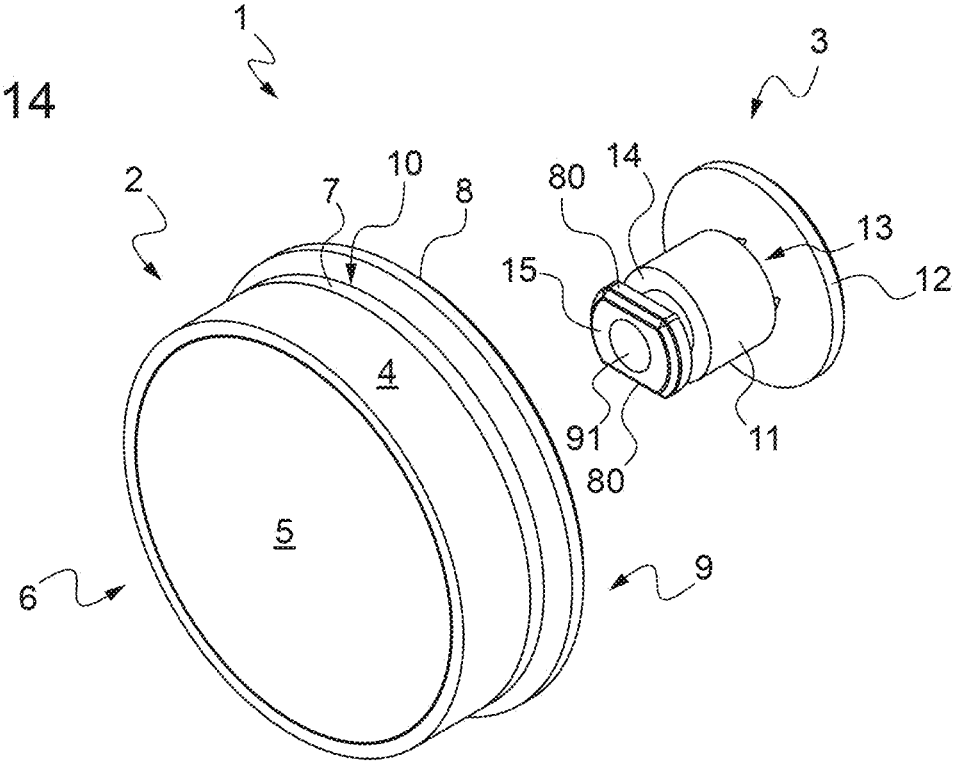
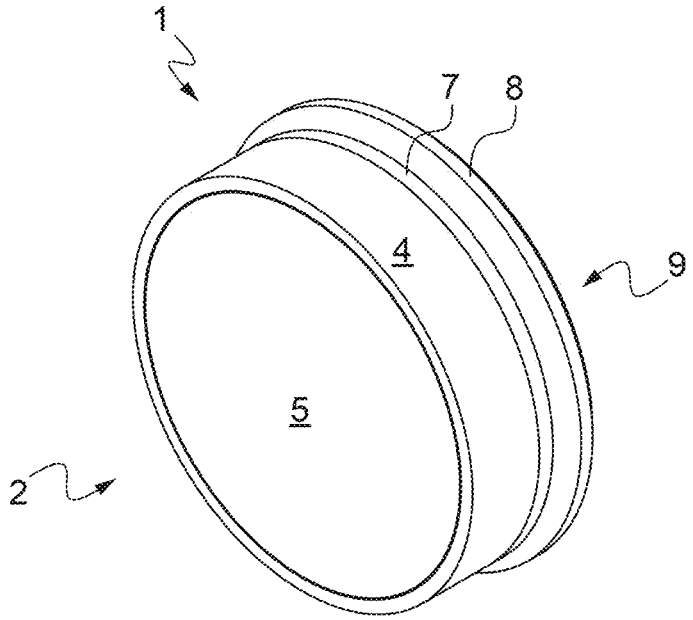
Fig.15

DEVICE FOR OPENING AND CLOSING AN ARTICLE, IN PARTICULAR OF NATURAL OR ARTIFICIAL LEATHER, AND AN ARTICLE COMPRISING SUCH A DEVICE

TECHNICAL FIELD OF THE INVENTION

The invention concerns a device for opening and closing an article, particularly of natural or artificial leather, also more commonly called a clasp.

The invention also concerns an article, particularly of natural or artificial leather, provided with such an opening and closing device.

STATE OF THE ART

Devices are known for opening and closing an article, particularly of natural or artificial leather, provided with a key and a cylinder enabling the locking and the unlocking of the device and thus the opening and the closing of the article, by insertion of a key into the cylinder and driving it rotationally. These devices are often called locks.

Devices are also known for opening and closing an article, particularly of natural or artificial leather, provided instead with a casing comprising a housing able to rotate between a first position that is stable and a second position. An assembly button, also called "tibi" in French of which a translation is "link button", is provided to be inserted into the casing and withdrawn from that casing when the housing is brought into its second position. These devices are often called clasps. When the housing is in its stable first position and the link button is inserted into the casing, the clasp is closed; whereas when the housing is in its stable first position and the link button is withdrawn from the casing, the clasp is open and the insertion of the link button into the casing is not possible.

PRESENTATION OF THE INVENTION

The invention is directed to providing a device for opening and closing an article, particularly of natural or artificial leather, of clasp type, with neither key nor cylinder, which is particularly simple and convenient with regard to both manufacture and use.

According to a first aspect, the invention thus relates to a device for opening and closing an article, particularly of natural or artificial leather, comprising a clasp casing and an assembly button configured to cooperate with said clasp casing, which clasp casing is provided with a mechanism having a locked configuration in which said article can be closed and an unlocked configuration in which said article may be opened, characterized in that said mechanism comprises a housing rotatably mounted relative to said clasp casing, between a stable first position and a second position, at least one locking member movably mounted in said clasp casing and configured to be driven by said housing, and a latch mounted movably with respect to translation in said clasp casing and configured to cooperate with said housing; said mechanism being configured such that: when said housing is in its stable first position and said assembly button is inserted into said clasp casing, said at least one locking member immobilizes said assembly button at least with respect to translation; when said housing is caused to rotate and passes from its stable first position to its second position, said at least one locking member is displaced until said assembly button is released and said latch is translationally driven within said clasp casing until said assembly button is pushed out of said clasp casing; when said housing is in its second position, said latch immobilizes said housing and said at least one locking member; and when said assembly button is re-inserted into said clasp casing, said assembly button pushes said latch which releases said housing and said at least one locking member, said housing is caused to rotate and passes from its second position to its stable first position and said at least one locking member is displaced until said assembly button is immobilized at least with respect to translation.

The opening and closing device according to the invention is particularly convenient in that it enables the article to be opened simply by rotating the housing, the assembly button being automatically released from the clasp casing by the action of the latch and the mechanism thus being in unlocked configuration.

Furthermore, the opening and closing device according to the invention is particularly convenient in that it enables the article to be closed simply by inserting the assembly button into the clasp casing, without having to act upon the housing.

As a matter of fact, the translation of the latch when the housing is rotationally driven from its stable first position to its second position makes it possible to maintain the housing in its second position, in which the assembly button can easily be withdrawn and/or inserted. Furthermore, since the housing drives the locking member into a position in which it releases the assembly button, the latter remains in that position and the assembly button can easily be withdrawn and/or inserted.

Particularly simple, convenient and economical features of the opening and closing device according to the invention are presented below.

Said housing comprises a plurality of windows, said mechanism comprises a housing plate provided with a plurality of chimneys which extend from an inside face of said housing plate and which are received in said windows of said housing, and said chimneys are displaced within said windows when said housing is caused to rotate and passes from its stable first position to its second position, and vice-versa.

Said mechanism comprises a first return member configured to return said housing to its stable first position, said first return member being formed for example by a tension spring.

Said housing comprises a complementary window, a first attachment stem as well as an at least partly circular inside wall, said housing plate is provided with a second attachment stem which projects from said inside face of said housing plate and which is received in said complementary window of said housing, and said first return member is at least partly disposed along said inside wall of said housing and mechanically connected, by a first end, to said first attachment stem and, by a second end which is an opposite end to said first end, to said second attachment stem.

Said housing comprises a first attachment stem, said mechanism comprises a ring housed in said housing, said ring is provided with an at least partly circular wall from which projects a second attachment stem as well as mounting lugs in which are received said chimneys of said housing plate, and said first return member is at least partly disposed along said wall of said ring and mechanically connected, by a first end, to said first attachment stem and, by a second end which is an opposite end to said first end, to said second attachment stem.

Said housing comprises a plurality of drive pins which extend from an outside face of said housing, towards said inside face of said housing plate, said mechanism comprises a plurality of blades forming such locking members, said blades are pivotally mounted on said chimneys of said housing plate and are provided with cut-outs in which are movably inserted said drive pins of said housing, said assembly button comprises a finger provided with a circular groove, and when said housing is in its stable first position, said blades are at least partly accommodated in said groove of said finger thereby locking said assembly button in said housing, whereas when said housing is in its second position, said blades are swiveled relative to said housing plate by the action of said drive pins of said housing in said cut-outs of said blades, said blades are at a distance from said groove of said finger and said assembly button may be released.

Said housing comprises a central through-opening, teeth which project into said central opening and which form such said locking members, said assembly button comprises a finger provided with a circular groove and flats formed at a free end of said finger, and when said housing is in its stable first position, said teeth of said housing are at least partly accommodated in said groove of said finger and said flats of said finger are disposed substantially perpendicularly to said teeth thereby locking said assembly button in said housing, whereas when said housing is in its second position, said flats are substantially aligned with said teeth and said assembly button can be released.

Said assembly button comprises a flange mechanically connected to said finger at an opposite end to said circular groove.

A space is provided between said flange and said finger to interpose therein a first portion of said article, particularly of natural or artificial leather, for the connection of said assembly button to said article.

Said mechanism further comprises a cover relative to which said housing is able to rotate, said latch is mounted on said cover and rotationally coupled relative to the latter, said latch is provided with at least one holding member and said housing is provided with at least one complementary holding member configured to cooperate with said at least one holding member of said latch when said housing is in its second position, to immobilize said housing and said at least one locking member.

Said cover is provided with a plurality of chimneys which extend from an inside face of said cover and said latch has the general form of a plate in which are provided notches receiving said chimneys of said cover, to immobilize the latter rotationally relative to said cover.

Said latch is provided with at least one recess forming said at least one holding member and said housing is provided with at least one protrusion projecting from an inside face of said housing and forming said at least one complementary holding member.

Said mechanism is configured in order for said at least one protrusion of said housing to come into abutment against an edge of said at least one recess of said latch, or is inserted into said at least one recess of said latch, when said housing is in its second position.

Said latch is furthermore provided with at least one shoulder forming at least one said recess which is progressive.

Said mechanism further comprises a second return member configured to make said latch bear against said housing when not acted upon externally, said second return member being formed for example by a compression spring.

Said cover is provided with a seat formed in its inside face and partially housing said second return member.

Said mechanism comprises a support pin having a base disposed against an inside face of said cover and a stem on which is mounted said second return member, said mechanism further comprises a sleeving member provided with an internal space into which is inserted said second return member mounted on said support pin, and also provided with an outside collar, and said latch is provided with an aperture and is slidingly mounted on said sleeving member, said outside collar of said sleeving member coming to bear against a face of said latch facing opposite said inside face of said cover.

Said housing is rotatably mounted between a housing plate and a cover, which are mechanically connected to each other, for example using fastening screws.

Said mechanism comprises a housing plate relative to which said housing is able to rotate, said housing plate is provided with a low wall which is at least partly circular, and said clasp casing further comprises a counter-plate mechanically connected to said housing plate and disposed against said low wall so as to provide a space between said housing plate and said counter-plate, to interpose therein a second portion of said article, particularly of natural or artificial leather, for the connection of said clasp casing to said article.

According to a second aspect, the invention also relates to an article, particularly of natural or artificial leather, comprising an opening and closing device as described above, a first portion on which is fastened an assembly button of said opening and closing device, and a second portion on which is fastened a clasp casing of said opening and closing device, said opening and closing device being configured to receive and immobilize said assembly button in said clasp casing in a locked configuration of a mechanism of said opening and closing device, and to release said assembly button from said clasp casing in an unlocked configuration of said mechanism.

BRIEF DESCRIPTION OF THE FIGURES

The disclosure of the invention will now be continued with the description of embodiments, given below by way of illustrative and non-limiting examples, with reference to the accompanying drawings.

FIG. 1 is a diagrammatic representation in perspective of an opening and closing device in accordance with the invention, having a clasp casing fastened to a first part of an article of natural or artificial leather, shown only partially, and an assembly button fastened to a second part of said article of natural or artificial leather, also shown only partially, in an unlocked configuration in which the assembly button is released and at a distance from the clasp casing.

FIG. 2 is a similar view to that of FIG. 1, showing the opening and closing device in a locked configuration in which the assembly button is inserted into the clasp casing.

FIG. 14 is a perspective view of a variant of the opening and closing device, in an unlocked configuration.

FIG. 15 is a perspective view of a variant of the opening and closing device, in a locked configuration.

DETAILED DESCRIPTION

Figure 3:
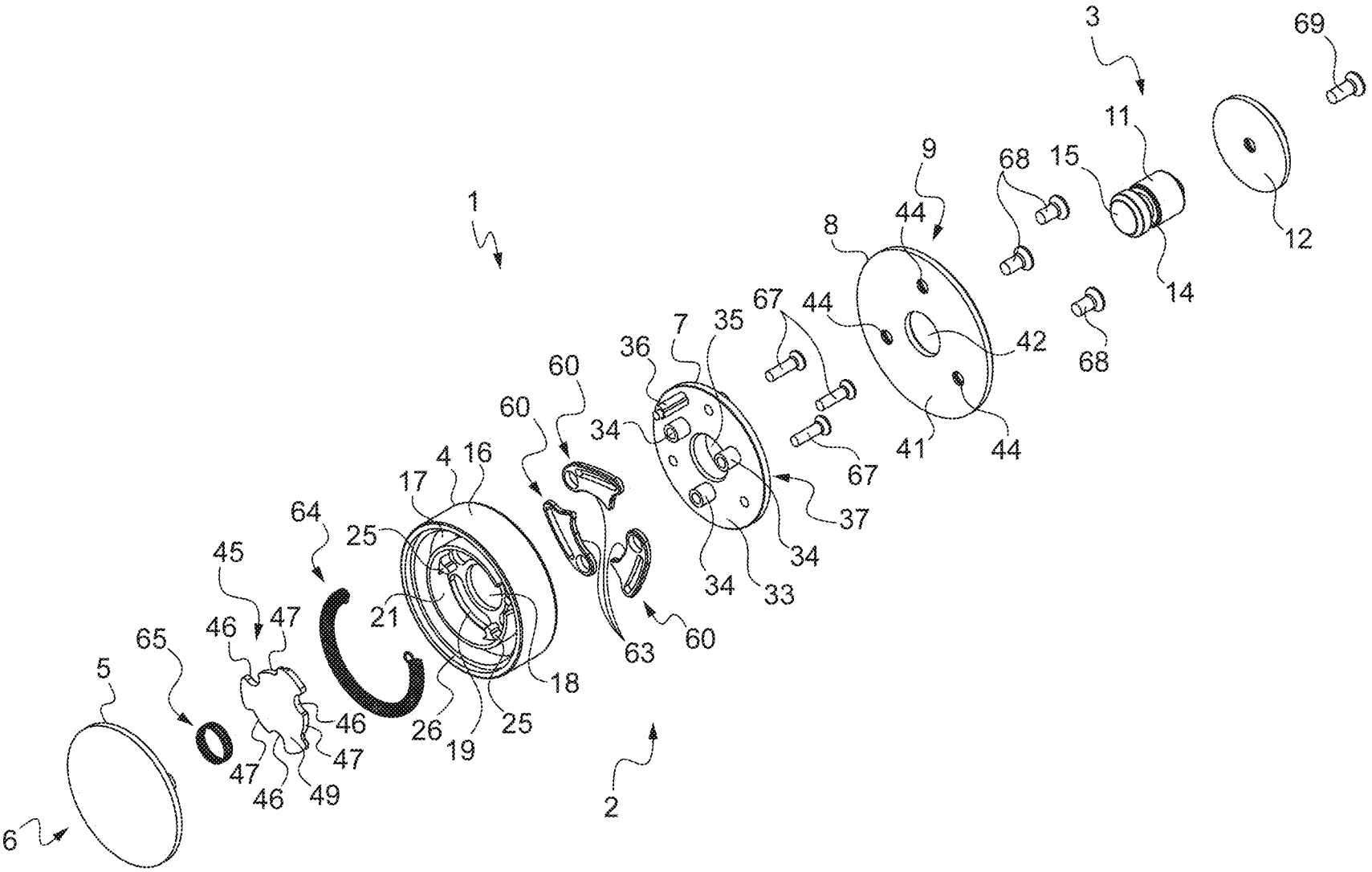
FIG. 3 is a diagrammatic exploded view in perspective of the opening and closing device of FIGS. 1 and 2.
Figure 4:
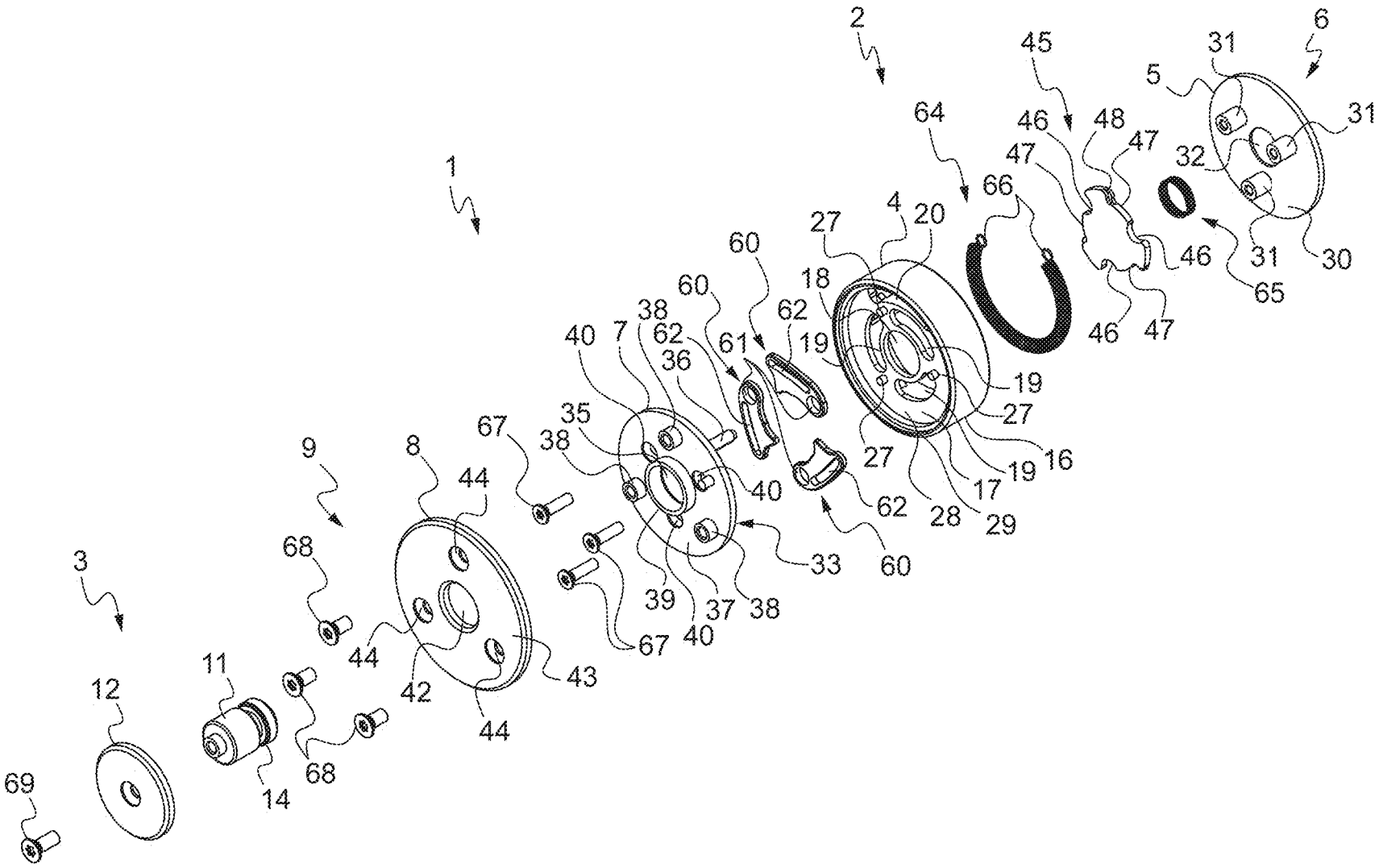
FIG. 4 is a diagrammatic exploded view in perspective of the opening and closing device of FIGS. 1 and 2.
Figure 5:
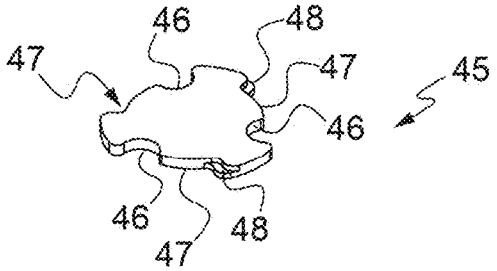
FIG. 5 is a diagrammatic representation in perspective of a latch of the opening and closing device.
Figure 6:
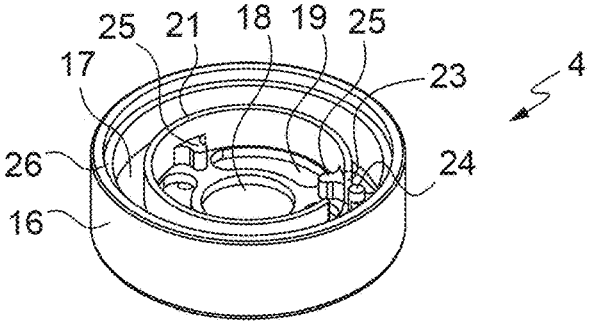
FIG. 6 is a diagrammatic exploded view in perspective of a housing of the opening and closing device.
Figure 7:
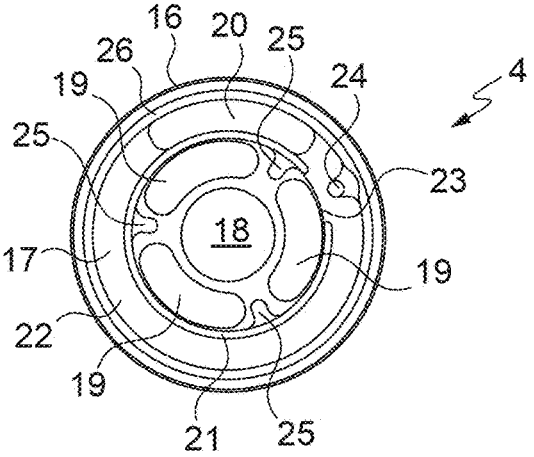
FIG. 7 is a diagrammatic front view of the housing of the opening and closing device.
Figure 8:
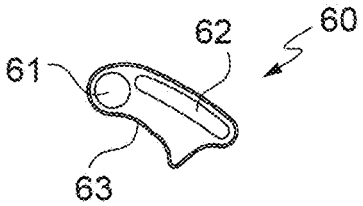
FIG. 8 is a diagrammatic front view of a blade of the opening and closing device.
Figure 9:
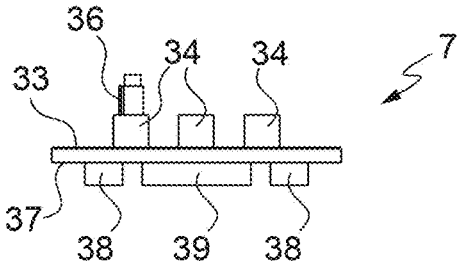
FIG. 9 is a diagrammatic side view of a housing plate of the opening and closing device.

FIGS. 1 and 2 illustrate an opening and closing device 1, also called clasp, for an article of natural or artificial leather (not shown).

The article of natural or artificial leather may for example comprise a first portion, or body, to which a second portion of the article, or flap, may be attached by a first end (not shown).

The opening and closing device 1, hereinafter clasp, comprises a clasp casing 2 and an assembly button 3 configured to cooperate with the clasp casing 2.

For example, assembly button 3 may be connected to the first portion, or body, of the article, while the clasp casing 2 may be connected to the second portion, or flap, of the article.

The clasp casing 2 is provided with a mechanism having a locked configuration in which the article may be closed and an unlocked configuration in which the article may be open.

The unlocked configuration of the mechanism of the clasp casing 2 can be seen in FIG. 1, in which the assembly button 3 is at a distance from the clasp casing 2, while the locked configuration of the mechanism of the clasp casing 2 can be seen in FIG. 2, in which the assembly button 3 is not visible since it is partially inserted into the clasp casing 2.

In particular, the mechanism of the clasp casing 2 comprises a housing 4 rotatably mounted relative to the clasp casing 2, between a stable first position in which the mechanism is in locked configuration (FIG. 2), and a second position (FIG. 1) in which the mechanism is in unlocked configuration.

The housing 4 is movably mounted between the cover 5 of the mechanism, located on a first side 6 of the clasp casing 2, and a housing plate 7 of the mechanism, located on a second side 9 of the clasp casing 2, which is an opposite side to the first side 6.

The housing 4 is interposed between the cover 5 and the housing plate 7 and is able to rotate relative to these latter, between its stable first position and its second position.

The clasp casing 2 may be provided with a counter-plate 8 located on the second side 9 and mechanically connected to the housing plate 7, while leaving a space 10 between the housing plate 7 and the counter-plate 8, to interpose therein for example the second portion, or flap, of the article, for the connection of the clasp casing 2 to that article.

The assembly button 3 comprises a finger 11 and a flange 12 mechanically connected to the finger 11, while leaving a space 13 between the flange 12 and the finger 11, to interpose therein for example the first portion, or body, of the article, for the connection of the assembly button 3 to that article.

The assembly button 3 is provided with a circular groove 14 formed near a free end 15 of the finger 11, at a remote opposite location from the flange 12. In other words, the flange 12 is mechanically connected to the finger 11 at an opposite end to the circular groove 14.

The opening and closing device 1 is configured here such that the assembly button 3 is inserted into and withdrawn from the clasp casing 2 by the second side 9 of the latter, that is to say from the side where the housing plate 7 and the counter-plate 8 are located, at a remote opposite location from the cover 5.

A description will now be given in more detail of the clasp casing 2 and of the assembly button 3 with reference to FIGS. 2 to 9.

The housing 4 of the clasp casing 2 has substantially the shape of a wheel rim and has an outer cylindrical wall 16 and a main wall 17 extending inside the outside cylindrical wall 16.

The housing 4 comprises a central through-opening 18 provided in the main wall 17.

The housing 4 comprises a plurality of windows 19 provided in the main wall 17 around the central opening 18.

The central opening 18 of the housing allows the passage of the finger 11 of the assembly button 3.

The housing 4 comprises a complementary window 20 provided in the main wall 17 and located substantially between a window 19 and the outside cylindrical wall 16.

The housing 4 comprises an inside wall 21 which is at least partly circular and which extends from an inside face 22 of the main wall 17.

The inside wall 21 here extends substantially concentrically and at a distance from the outside cylindrical wall 16, around the windows 19.

The complementary window 20 is thus located between the inside wall 21 and the outside cylindrical wall 16.

A gap 23 is provided in the inside wall 21 and the housing 4 comprises a first attachment stem 24 located opposite the gap 23.

The first attachment stem 24 extends from the inside face 22 of the main wall 17, near the outside cylindrical wall 16.

The first attachment stem 24 may thus also be located near the complementary window 20.

The housing 4 here comprises a plurality of holding members 25 referred to as complementary holding members here formed in the main wall 17.

In the described example, the complementary holding members of the housing 4 are formed by protrusions 25 projecting from the inside face 22 of the main wall 17.

Each protrusion 25 may be located between two successive windows 19 and be joined to the partially circular inside wall 21.

The housing 4 furthermore has a first shoulder 26 provided in the outside cylindrical wall 16, on the same side as the inside face 22 of the main wall 17 and of the first side 6 of the clasp casing 2, and provided to form a seat for the cover 5.

The housing also comprises one or more drive pins 27 which extend from an outside face 28 of the main wall 17.

In the described example, each drive pin 27 may be located between two successive windows 19 and thus be situated substantially at a remote opposite location from the protrusions 25, that is to say on the other side from the main wall 17.

The housing 4 furthermore has a second shoulder 29 provided in the outside cylindrical wall 16, on the same side as the outside face 28 of the main wall 17 and of the second side 9 of the clasp casing 2, and provided to form a seat for the housing plate 7.

The cover 5 of the clasp casing 2 has an inside face 30 from which project several first chimneys 31, as well as a seat 32 provided in its inside face 30.

The first chimneys 31 of the cover 5 here have tapped holes and may be regularly distributed around the seat 32.

The housing plate 7 of the clasp casing 2 has an inside face 33 from which project several second chimneys 34 which are configured to be received in the windows 19 of the housing 4.

The housing plate 7 has a central through-opening 35 around which may be regularly distributed the second chimneys 34.

The central opening 35 of the housing plate 7 enables the passage of the finger 11 of the assembly button 3.

The second chimneys 34 of the housing plate 7 here have tapped holes which are open on an outside face 37 of the housing plate 7 which is an opposite face to the inside face 33, at the location of the first apertures 40.

The housing plate 7 comprises a second attachment stem 36 which projects from the inside face 33 of the housing plate and which is located for example here near the periphery of the housing plate 7.

The second attachment stem 36 is configured to be received in the complementary window 20 of the housing 4.

The housing plate 7 further comprises a low wall 39 which is at least partly circular and which projects from the outside face 37 of the housing plate 7. The low wall 39 extends for example here around the central opening 35.

The housing plate 7 further comprises third chimneys 38 which project from the outside face 37 and which may for example be regularly distributed around the low wall 39.

The third chimneys 38 of the housing plate 7 here have tapped holes which are open on the inside face 33.

It will be noted that the first apertures 40 are for example here regularly distributed around the low wall 39 and between the third chimneys 38.

The counter-plate 8 is configured to be mechanically connected to the housing plate 7 and has an inside face 41 provided to be disposed against the low wall 39 so as to provide the space 10 between the housing plate 7 and the counter-plate 8.

The counter-plate 8 has a central opening 42 which is open both on the inside face 41 and on an outside face 43 which is an opposite face to the inside face 41 of the counter-plate 8.

The central opening 42 of the counter-plate 8 enables the passage of the finger 11 of the assembly button 3.

The counter-plate 8 has second apertures 44 open both on the inside and outside faces 41 and 43 of the counter-plate 8.

These second apertures 44 of the counter-plate 8 are for example here regularly distributed around the central opening 42 of that counter-plate 8.

The mechanism is provided with a latch 45 mounted movably with respect to translation in the clasp casing 2 and configured to cooperate with the housing 4.

The latch 45 has the general form of a plate in which are provided notches 46 configured to receive the first chimneys 31 of the cover, so as to immobilize the latch 45 rotationally relative to the cover 5.

The notches 46 for example here have a substantially round bottom to receive a respective section of the respective first chimneys 31.

The latch 45 is thus mounted on the cover 5 and rotationally coupled to the latter.

The latch 45 is provided with one or more holding members, here formed by recesses 47, and configured to cooperate with the protrusions 25 of the housing 4 when the latter is in its second position.

The latch 45 is furthermore provided with shoulders 48 formed in the plate forming the latch 45, so as to form recesses 47 which are progressive.

In particular, the mechanism of the clasp casing 2 is configured here in order for the protrusions 25 of the housing 4 to come into abutment against the edges of the respective recesses 47 of the latch 45.

This makes it possible to progressively hold the housing 4 in its stable first position.

The mechanism of the clasp casing 2 is also provided with one or more locking members 60 movably mounted in the clasp casing 2 and configured to be driven by the housing 4.

These locking members are formed by blades 60 which have substantially the form of hooks, and which are each provided with a third aperture 61 for the swivel mounting of each of the blades 60 on the second chimneys 34 of the housing plate 7.

The blades 60 are each provided with a cut-out 62, having an elongate shape and in which is configured, to be movably received, a respective drive pin 27 of the housing 4.

The blades 60 furthermore each have a contour having a cross-section 63 which is curved and provided to be accommodated at least partly in the groove 14 of the finger 11 of the assembly button 3 when the housing 4 is in its stable first position.

The mechanism of the clasp casing 2 is furthermore provided with a first return member 64, formed for example by a tension spring, and by a second return member 65, formed for example here by a compression spring.

The first return member 64 has a substantially semi-circular shape and is provided with attachment points 66 at the first and second opposite ends of this first return member 64.

The first return member 64 is accommodated in the housing 4, between the cylindrical outside wall 16 and the semi-circular inside wall 21, and is mechanically connected both to the first attachment stem 24 of the housing 4 by one of the attachment points of the first return member 64 and to the second attachment stem 36 of the housing plate 7 by the other of the attachment points of the first return member 64.

The second return member 65 is configured to cause the latch 45 to bear against the housing 4 when not acted upon externally.

In particular, the second return member 65 is partially accommodated in the seat 32 provided in the cover 5 and comes to bear against an outside face 49 of the latch 45.

The mechanism of the clasp casing 2 also comprises first fastening screws 67 which make it possible to mechanically connect the housing plate 7 to the cover 5, while passing through the first apertures 40, the second chimneys 34 of the housing plate 7 and the lugs 85 of the ring 81, and by being inserted in the first chimneys 31 of the cover 5 which are located directly opposite the second chimneys 34 of the housing plate 7 and the lugs 85 of the ring 81.

The housing 4 is thus interposed between the housing plate 7 and the cover 5 while being able to rotate between them.

The mechanism of the clasp casing 2 comprises second fastening screws 68 which enable the counter-plate 8 to be mechanically connected to the housing plate 7, while passing through the second apertures 44 of the counter-plate 8 and by being inserted into the third chimneys 38 of the housing plate 7.

A third fastening screw 69 is also provided to mechanically connect the flange 12 of the assembly button 3 to its finger 11.

A description will now be given of the operation of the opening and closing device 1 and the cooperation of the parts which it comprises, with reference to FIGS. 10, 10A, 10B to 13, 13A, 13B.

Figure 10:
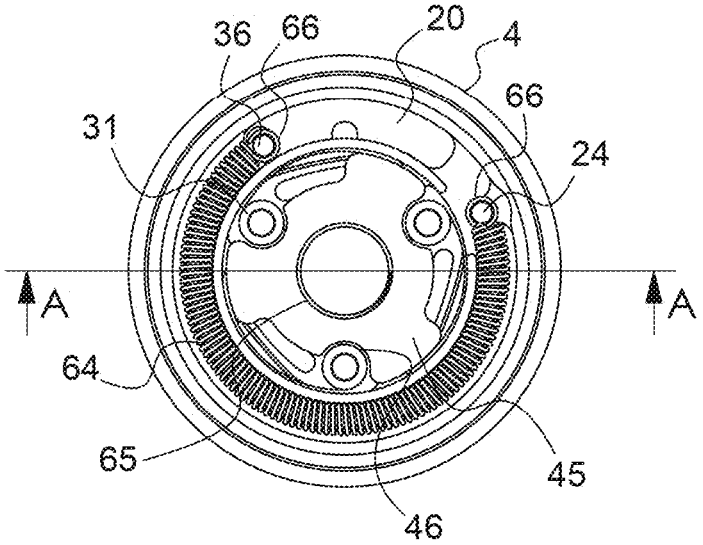
FIG. 10 is a front view of the opening and closing device, in the locked configuration and with a cover of the clasp casing that has been removed.
Figure 10A:
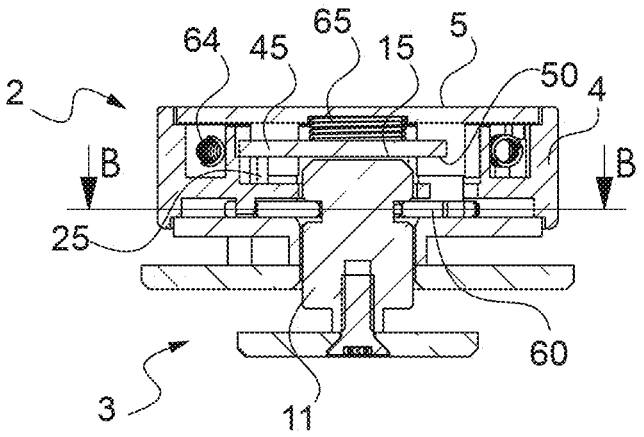
FIG. 10A is a cross section view marked A-A in FIG. 10.
Figure 10B:
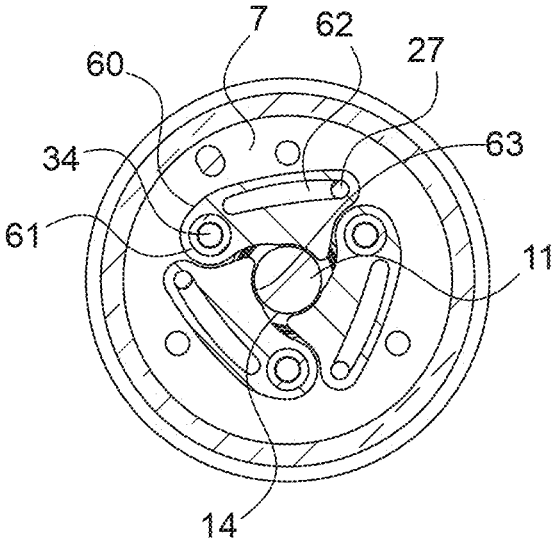
FIG. 10B is a cross section view marked B-B in FIG. 10A.

FIGS. 10, 10A and 10B show the opening and closing device 1 when the mechanism is in its locked configuration.

In this locked configuration of the mechanism, the housing 4 is in its stable first position, the assembly button 3 is inserted into the clasp casing 2, and the blades 60 immobilize the finger 11 of the assembly button 3 at least with respect to translation.

In particular, the first return member 64 is not acted upon and has its attachment points 66 mechanically connected respectively to the first attachment stem 24 of the housing 4 and to the second attachment stem 36 of the housing plate 7, this second attachment stem 36 being inserted into the complementary window 20 of the housing 4.

In the stable first position of the housing 4, the second attachment stem 36 is located at a first end of the window 20.

The second return member 65 is compressed between the cover 5 and the outside face 49 of the latch 45 and the latter rests, by an inside face 50 which is an opposite face to its outside face 49, on the protrusions 25 of the housing 4.

The latch 45 is furthermore rotationally immobilized by the first chimneys 31 of the cover 5 which are located in the notches 46 of the latch 45.

The blades 60 are mounted to swivel on the housing plate 7 by virtue of the second chimneys 34 of the housing plate 7 which are inserted into the third apertures 61 of the blades 60.

The drive pins 27 of the housing 4 are received in the cut-outs 62 of the blades 60, and are located at a first end of the cut-outs 62, such that the blades 60 are in a configuration in which they are brought the closest to each other.

Thus, the blades 60 are at least partly housed in the groove 14 of the finger 11, the sections 63 of the contours of the blades 60 thus locking the assembly button 3 in the housing 4.

Figure 11:
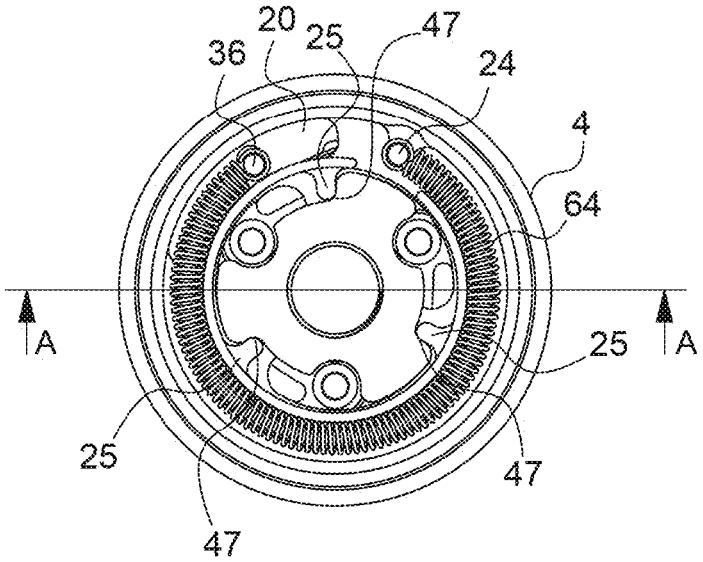
FIG. 11 is a similar view to that of FIG. 10, showing the passage from the locked configuration of the opening and closing device to its unlocked configuration.
Figure 11A:
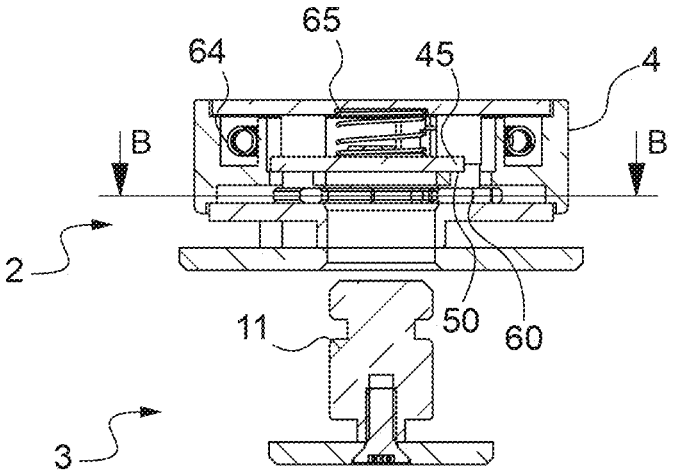
FIG. 11A is a similar view to that of FIG. 10A, showing the passage from the locked configuration of the opening and closing device to its unlocked configuration.
Figure 11B:
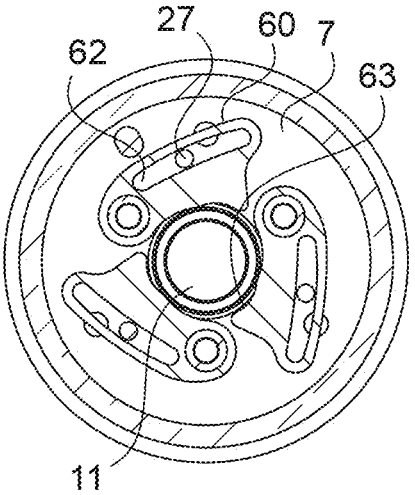
FIG. 11B is a similar view to that of FIG. 10B, showing the passage from the locked configuration of the opening and closing device to its unlocked configuration.

FIGS. 11, 11A and 11B show the opening and closing device 1 when the mechanism passes from its locked configuration to its unlocked configuration.

The housing 4 is rotationally driven from its stable first position to its second position.

The first return member 64 is placed in tension by the movement of the first attachment stem 24 of the housing 4 in relation to the second attachment stem 36 which remains fixed.

The complementary window 20 of the housing 4 is again moved such that the second attachment stem 36 is located substantially at the center of that complementary window 20.

The protrusions 25 of the housing 4 are also moved relative to the latch 45.

These protrusions 25 slide against the inside face 50 of the latch 45 until they arrive adjacent the recesses 47 formed in the latch 45.

The latch 45 is then translated within the clasp casing 2 by the action of the second return member 65 which relaxes.

Furthermore, the movement of the housing 4 drives the movement of its drive pins 27, which themselves move within the cut-outs 62 of the blades 60, thereby spreading the blades 60 away from each other by swiveling.

The drive pins 27 of the housing 4 are located substantially at the center of the cut-outs 62 of the blades 60, the blades 60 withdraw from the groove 14 of the finger 11 and the sections 63 of the contours of the blades 60 unlock the assembly button 3.

The action of the second return member 65 on the latch 45 causes the latter to push the finger 11 of the assembly button 3 out of the clasp casing 2.

Figure 12:
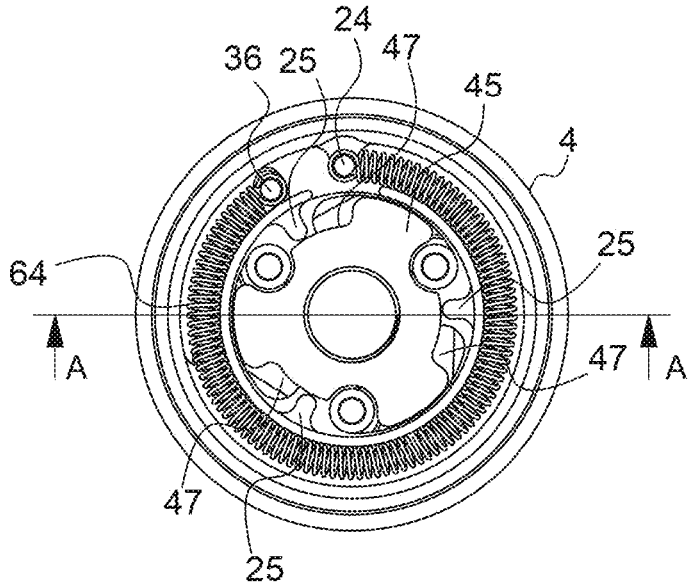
FIG. 12 is a similar view to that of FIG. 11, showing the opening and closing device in its unlocked configuration.
Figure 12A:
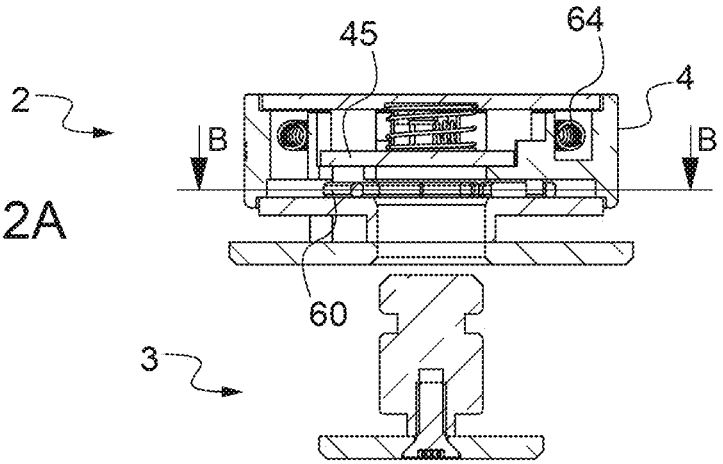
FIG. 12A is a similar view to that of FIG. 11A, showing the opening and closing device in its unlocked configuration.
Figure 12B:
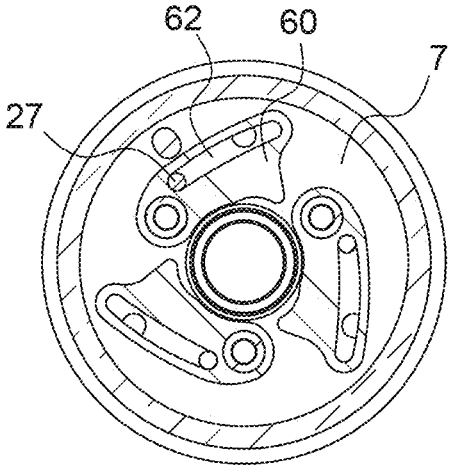
FIG. 12B is a similar view to that of FIG. 11B, showing the opening and closing device in its unlocked configuration.

FIGS. 12, 12A and 12B show the opening and closing device 1 when the mechanism is in its unlocked configuration and the housing 4 has been turned to the maximum.

In this unlocked configuration of the mechanism, it can be seen that the housing 4 may by turned further always by moving away from its stable first position, even after the withdrawal of the assembly button 3.

The first return member 64 is again placed in tension by the movement of the first attachment stem 24 of the housing 4 in relation to the second attachment stem 36 which remains fixed.

The complementary window of the housing 4 is again moved such that the second attachment stem 36 is located substantially at an opposite end of that complementary window.

The protrusions 25 of the housing 4 are also moved relative to the latch 45.

These protrusions 25 move along the recesses 47 of the latch 45 and approach the notches 46.

Furthermore, the movement of the housing 4 further drives the movement of its drive pins 27, which themselves move within the cut-outs 62 of the blades 60 until they reach an opposite end of these latter, thereby further spreading the blades 60 away from each other by swiveling.

Figure 13:
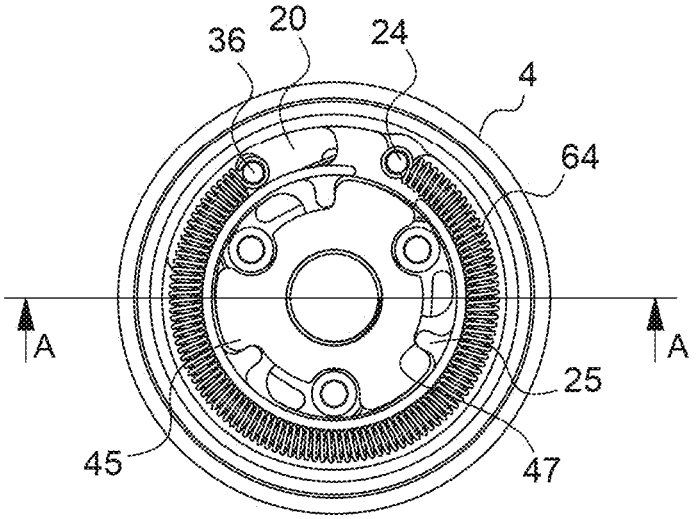
FIG. 13 is a similar view to that of FIG. 12, showing the passage from the unlocked configuration of the opening and closing device to its locked configuration.
Figure 13A:
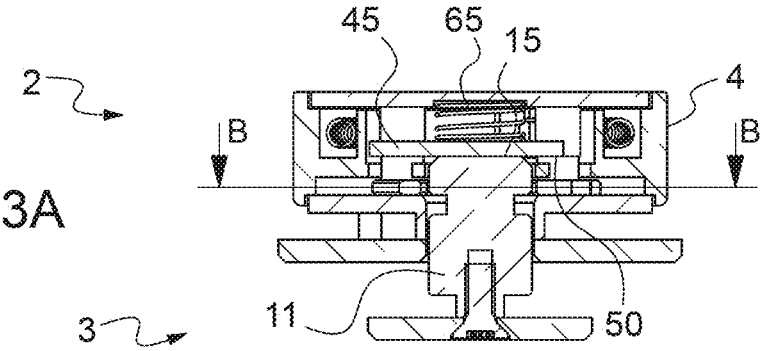
FIG. 13A is a similar view to that of FIG. 12A, showing the passage from the unlocked configuration of the opening and closing device to its locked configuration.
Figure 13B:
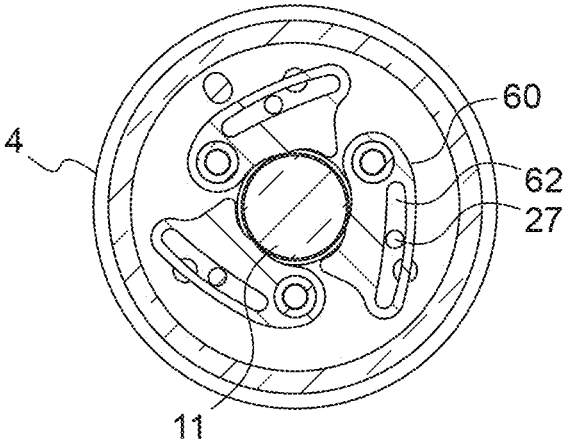
FIG. 13B is a similar view to that of FIG. 12B, showing the passage from the unlocked configuration of the opening and closing device to its locked configuration.

FIGS. 13, 13A and 13B show the opening and closing device 1 when the mechanism passes from its unlocked configuration to its locked configuration.

The housing 4 has been partially returned by the first return member 64 towards its stable first position.

The first attachment stem 24 of the housing 4 has been moved in relation to the second attachment stem 36 which remains fixed, the complementary window 20 of the housing 4 has also been moved such that the second attachment stem 36 is located substantially between the opposite end and the center of that complementary window 20.

The protrusions 25 of the housing 4 have also been moved relative to the latch 45 until they come into abutment against the edges of the recesses 47 of the latch 45.

Furthermore, the return of the housing 4 drives the movement of its drive pins 27, which themselves move in the cut-outs 62 of the blades 60 until they come to be located between the opposite end and the center of these latter. The blades 60 swivel and move slightly towards each other.

It is thus the cooperation of the protrusions 25 of the housing with the edges of the recesses of the latch 45 which make it possible to immobilize the housing 4 and prevent its return into its stable first position, and which also make it possible to immobilize the blades 60 and prevent them coming together too much.

The finger 11 of the assembly button 3 is next re-inserted into the clasp casing 2.

The free end 15 of the finger 11 comes to bear against the inside face 50 of the latch 45 and pushes the latter against the second return member 65, which becomes compressed.

The latch 45 is then rotationally driven towards the cover 5. The latch 45 thus moves apart from the housing 4 until the cooperation between the protrusions 25 of the housing 4 and the edges of the resources 47 of the latch 45 is interrupted.

This interruption may be made in two phases thanks to the shoulders 48 provided at the location of the recesses 47.

This makes it possible to ensure that the finger 11 of the assembly button 3 is sufficiently re-inserted into the clasp casing 2.

The latch 45 thus releases the housing 4, which is returned into its stable first position by the action of the first return member 64, thereby bringing the blades 60 towards each other sufficiently to enter into the groove 14 of the finger 11 and thereby lock the assembly button 3 in the clasp casing 2. The configuration of FIGS. 10, 10A and 10B is thus returned to.

The opening and closing device 1 is particularly convenient in that it enables the article to be opened simply by rotating the housing 4, the assembly button 3 being automatically released from the clasp casing 2 by the action of the latch 45 and the mechanism thus being in unlocked configuration.

Furthermore, the opening and closing device 1 is particularly convenient in that it enables the article to be closed simply by inserting the assembly button 3 into the clasp casing 2, without having to act upon the housing 4.

As a matter of fact, the translation of the latch 45 when the housing 4 is rotationally driven from its stable first position to its second position makes it possible to maintain the housing 4 in its second position, in which the assembly button 3 can easily be withdrawn and/or inserted. Furthermore, since the housing 4 drives the blades 60 into a position in which they release the assembly button 3, the latter remains in that position and it can easily be withdrawn and/or re-inserted.

FIGS. 14 to 21B illustrate a variant embodiment of the opening and closing device described above. The same numerical references have been used for similar parts.

The opening and closing device illustrated in FIGS. 14 to 21B differ structurally from that illustrated in FIGS. 1 to 13B basically in that the finger of the assembly button has a different form, in that this finger is held directly by the housing, in that the second attachment stem comes from a part mounted in the housing, and in that the second return member is mounted on a pin itself inserted into a sleeving member, between the latch and the cover.

In particular, FIGS. 14 and 15 are similar to FIGS. 1 and 2 and illustrate the opening and closing device 1, which comprises the clasp casing 2 provided with the mechanism having a locked configuration in which the article can be closed and an unlocked configuration in which the article can be opened, and the assembly button 3 configured to cooperate with the clasp casing 2.

The mechanism of the clasp casing 2 comprises the housing 4 rotatably mounted relative to the clasp casing 2, between the stable first position in which the mechanism is in locked configuration (FIG. 15), and a second position (FIG. 14) in which the mechanism is in unlocked configuration. The housing 4 is moveably mounted between the cover 5 of the mechanism, located at the first side 6 of the clasp casing 2, and the housing plate 7 of the mechanism, located at the second side 9 of the clasp casing 2, which is an opposite side to the first side 6, and is interposed between the cover 5 and the housing plate 7 and is able to rotate relative thereto, between its stable first position and its second position. The clasp casing 2 can be provided with the counter-plate 8 located on the second side 9 and mechanically connected to the housing plate 7, while leaving a space 10 between the counter-plate 8 and the housing plate 7.

The assembly button 3 comprises a finger 11 and a flange 12 mechanically connected to the finger 11, while leaving a space 13 between the flange 12 and the finger 11. The assembly button 3 is provided with a circular groove 14 formed near a free end 15 of the finger 11, at a remote opposite location from the flange 12. In other words, the flange 12 is mechanically connected to the finger 11 at an opposite end to the circular groove 14. The assembly button 3 furthermore has flats 80 provided at the location of that free end 15, beyond the groove 14, as well as a hole 91 open at the location of its free end 15. The groove 14 is thus located between the flange 12 and the flats 80.

Figure 16:
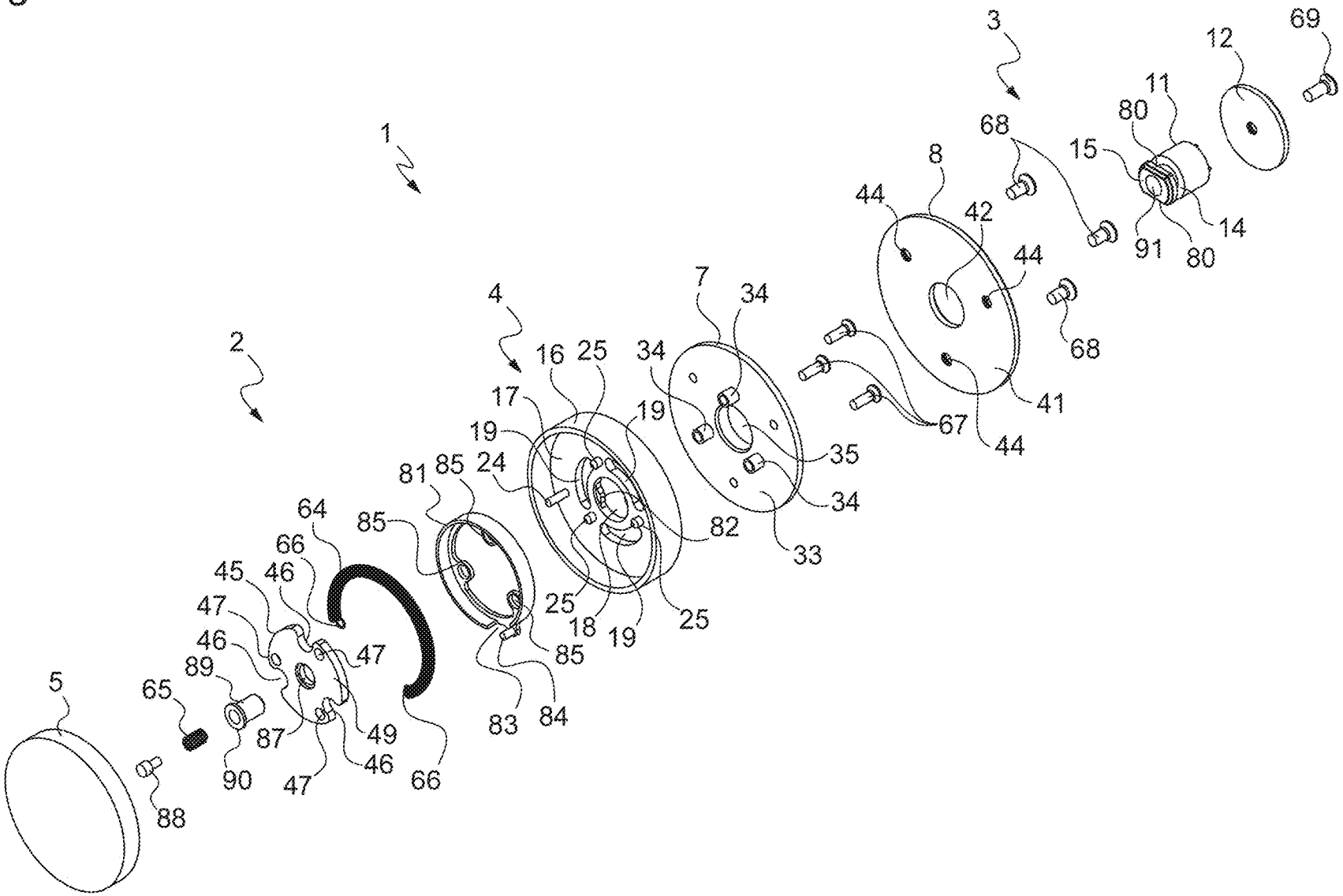
FIG. 16 is an exploded perspective view similar to that of FIG. 3, for the variant of the opening and closing device.
Figure 17:
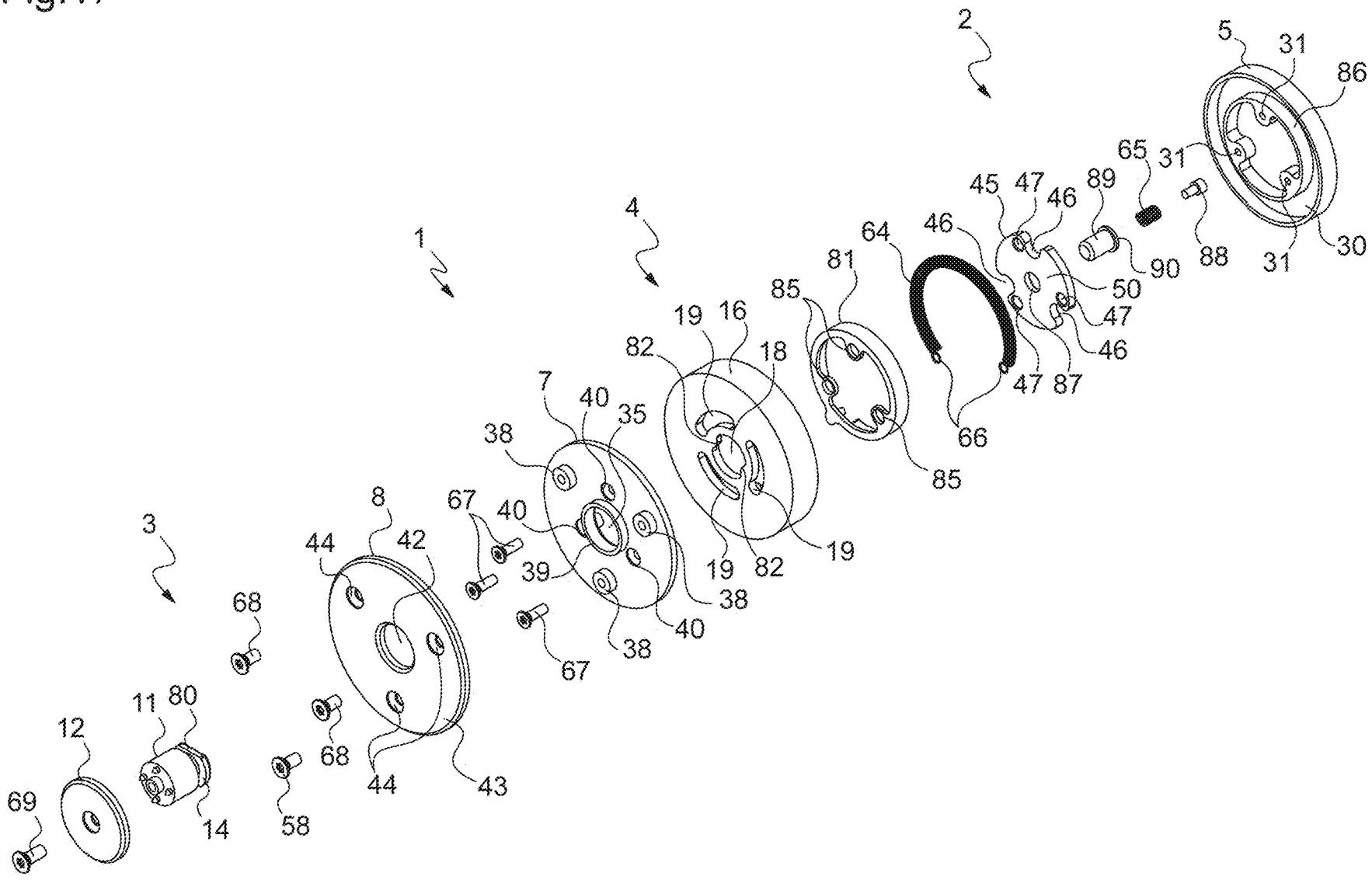
FIG. 17 is an exploded perspective view similar to that of FIG. 4, for the variant of the opening and closing device.

A description will now be given in more detail of the clasp casing 2 and of the assembly button 3 with reference to FIGS. 16 and 17.

The housing 4 has an outside cylindrical wall 16 and a main wall 17 extending inside the outside cylindrical wall 16 The housing 4 comprises a central through-opening 18 provided in the main wall 17. The housing 4 comprises a plurality of windows 19 provided in the main wall 17 around the central opening 18. The central opening 18 of the housing allows the passage of the finger 11 of the assembly button 3. The housing 4 comprises a first attachment stem 24 which extends from an inside face 22 of the main wall 17, near the outside cylindrical wall 16. The housing 4 here comprises a plurality of holding members 25 referred to as complementary holding members here formed in the main wall 17. In the described example, the complementary holding members of the housing 4 are formed by protrusions 25 projecting from the inside face 22 of the main wall 17. Each protrusion 25 may be located between two successive windows 19 and be joined to the partially circular inside wall 21. The housing 4 is furthermore provided with teeth 82 projecting into the central opening 18. These teeth 82 are disposed here facing each other.

The mechanism comprises a ring 81 housed in the housing 4, mainly formed by a wall that is at least partly circular which is provided with a gap 83 at the location of which is provided a second attachment stem 84 as well as mounting lugs 85. The ring 81 is disposed against the inside face 22 of the main wall 17 of the housing 4 and extends here substantially concentrically and at a distance from the outside cylindrical wall 16, around the windows 19 of the housing 4.

The cover 5 has an inside face 30 from which project several first chimneys 31 which are connected by a lateral wall 86 forming a rim. The first chimneys 31 of the cover 5 here have tapped holes and may be regularly distributed along the lateral wall 86.

The housing plate 7 has an inside face 33 from which project several second chimneys 34 which are configured to be received in the windows 19 of the housing 4. The housing plate 7 has a central through-opening 35 around which may be regularly distributed the second chimneys 34. The central opening 35 of the housing 7 enables the passage of the finger 11 of the assembly button 3. The second chimneys 34 of the housing plate 7 here have tapped holes which are open on an outside face 37 of the housing plate 7 which is an opposite face to the inside face 33, at the location of the first apertures 40. The housing plate 7 further comprises a low wall 39 which is at least partly circular and which projects from the outside face 37 of the housing plate 7. The low wall 39 extends for example here around the central opening 35. The housing plate 7 further comprises third chimneys 38 which project from the outside face 37 and which may for example be regularly distributed around the low wall 39. The third chimneys 38 of the housing plate 7 here have tapped holes which are open on the inside face 33. It will be noted that the first apertures 40 are for example here regularly distributed around the low wall 39 and between the third chimneys 38.

The counter-plate 8 is configured to be mechanically connected to the housing plate 7 and has an inside face 41 provided to be disposed against the low wall 39 so as to provide the space 10 between the housing plate 7 and the counter-plate 8. The counter-plate 8 has a central opening 42 which is open both on the inside face 41 and on an outside face 43 which is an opposite face to the inside face 41 of the counter-plate 8. The central opening 42 of the counter-plate 8 enables the passage of the finger 11 of the assembly button 3. The counter-plate 8 has second apertures 44 open both on the inside and outside faces 41 and 43 of the counter-plate 8. These second apertures 44 of the counter-plate 8 are for example here regularly distributed around the central opening 42 of that counter-plate 8.

The mechanism is provided with a latch 45 mounted movably with respect to translation in the clasp casing 2 and configured to cooperate with the housing 4. The latch 45 has the general form of a plate in which are provided notches 46 configured to receive the first chimneys 31 of the cover, so as to immobilize the latch 45 rotationally relative to the cover 5. The notches 46 for example here have a substantially round bottom to receive a respective section of the respective first chimneys 31 The latch 45 is thus mounted on the cover 5 and rotationally coupled to the latter. The latch 45 is provided with one or more holding members, here formed by recesses 47, or holes and configured to cooperate with the protrusions 25 of the housing 4 when the latter is in its second position. The latch 45 is furthermore provided with shoulders 48 formed in the plate forming the latch 45, so as to form recesses 47 which are progressive. In particular, the mechanism of the clasp casing 2 is configured here in order for the protrusions 25 of the housing 4 to be inserted into the respective recesses 47 of the latch 45. This makes it possible to progressively hold the housing 4 in its stable first position. The latch 45 is also provided here with a central opening 87.

The mechanism is furthermore provided with a first return member 64, formed for example here by a tension spring. The first return member 64 has a substantially semi-circular shape and is provided with attachment points 66 at the first and second opposite ends of this first return member 64. The first return member 64 is accommodated in the housing 4, between the cylindrical outside wall 16 and the wall of the ring 81, and is mechanically connected both to the first attachment stem 24 of the housing 4 by one of the attachment points of the first return member 64 and to the second attachment stem 84 of the ring 81 by the other of the attachment points of the first return member 64.

The mechanism is furthermore provided with a second return member 65, formed for example here by a compression spring, a support pin 88 having a base disposed against an inside face 30 of the cover 5 and a stem on which is mounted the second return member 65, and a sleeving member 89 provided with an internal space in which may be inserted the second return member 65 mounted on the support pin 88 and provided with an external collar 90 at one end of the sleeving member 89. The latch 45 is configured to be slidingly mounted on the sleeving member 89 through its central opening 87, with the external flange 90 which comes to bear against an outside face 49 of the latch 45 facing the inside face 30 of the cover 5. The second return member 65 is configured to cause the latch 45 to bear against the housing 4 when not acted upon externally.

The mechanism also comprises first fastening screws 67 which enable the housing plate 7 to be mechanically connected to the cover 5, by passing through the first apertures 40 and the second chimneys 34 of the housing plate 7 and by being inserted in the first chimneys 31 of the cover 5 which are located directly opposite the second chimneys 34 of the housing plate 7 The housing 4 is thus interposed between the housing plate 7 and the cover 5 while being able to rotate between them. The mechanism also comprises second fastening screws 68 which enable the counter-plate 8 to be mechanically connected to the housing plate 7, while passing through the second apertures 44 of the counter-plate 8 and by being inserted into the third chimneys 38 of the housing plate 7. A third fastening screw 69 is also provided to mechanically connect the flange 12 of the assembly button 3 to its finger 11.

A description will now be given of the operation of the variant of the opening and closing device 1 and the cooperation of the parts which it comprises, with reference to FIGS. 18, 18A, 18B to 20, 20A, 20B.

Figure 18:
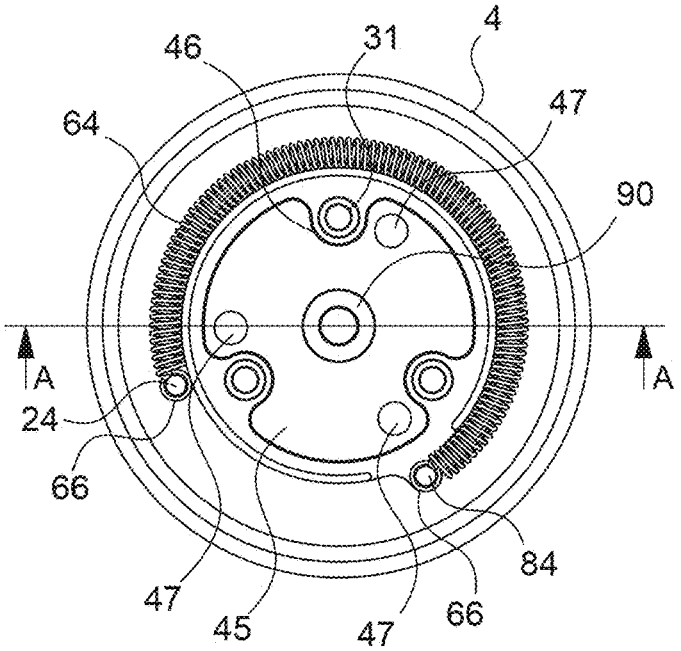
FIG. 18 is a similar view to that of FIG. 10, showing the variant of the opening and closing device in its locked configuration.
Figure 18A:
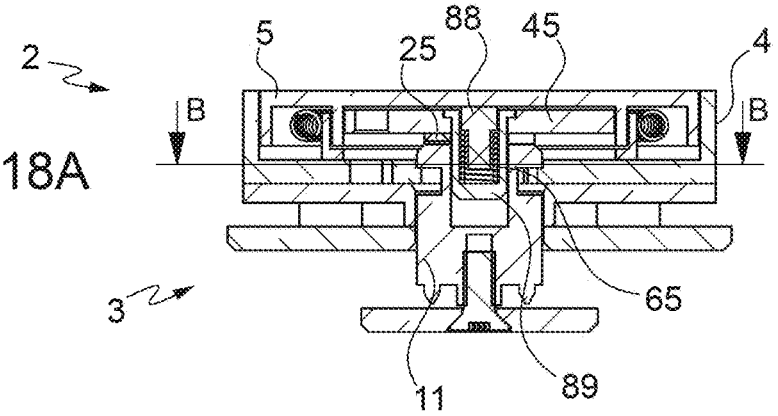
FIG. 18A is a similar view to that of FIG. 10A, showing the variant of the opening and closing device in its locked configuration.
Figure 18B:
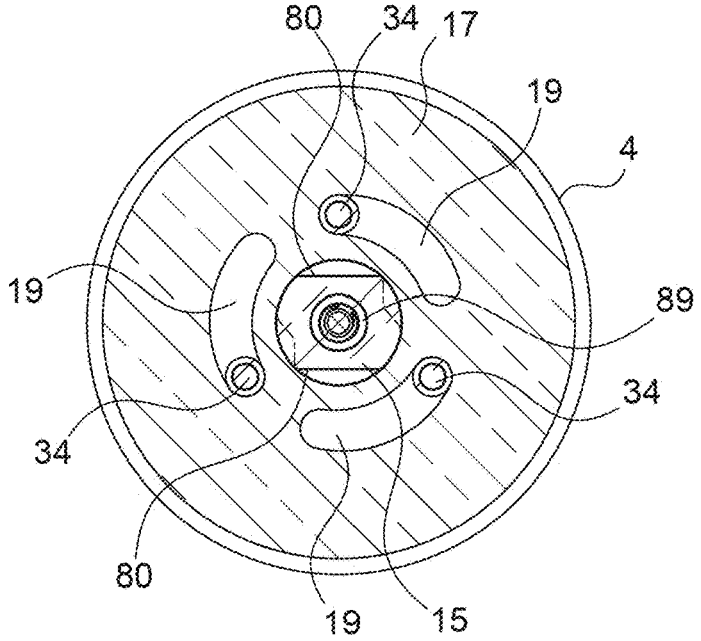
FIG. 18B is a similar view to that of FIG. 10B, showing the variant of the opening and closing device in its locked configuration.

FIGS. 18, 18A and 18B show the opening and closing device 1 when the mechanism is in its locked configuration. In this locked configuration of the mechanism, the housing 4 is in its stable first position, the assembly button 3 is inserted into the clasp casing 2, with the teeth 82 of the housing 4 being at least partly accommodated in the groove 14 of the finger 11 and the flats 80 of the finger 11 being disposed substantially perpendicularly to the teeth 82 of the housing 4, thus locking the assembly button 3 in the housing 4. The first return member 64 is not acted upon and has its fastening points 66 mechanically connected respectively to the first attachment stem 24 of the housing 4 and to the second attachment stem 84 of the ring 81. The second return member 65 is compressed between the base of the support pin 88 and the bottom of the sleeving member 89, which is partially inserted into the hole 91 provided in the finger 11 of the assembly button 3, and the latch 45 rests, by an inside face 50 which is an opposite face to its outside face 49, on the protrusions 25 of the housing 4. The latch 45 is furthermore rotationally immobilized by the first chimneys 31 of the cover 5 which are located in the notches 46 of the latch 45.

Figure 19:
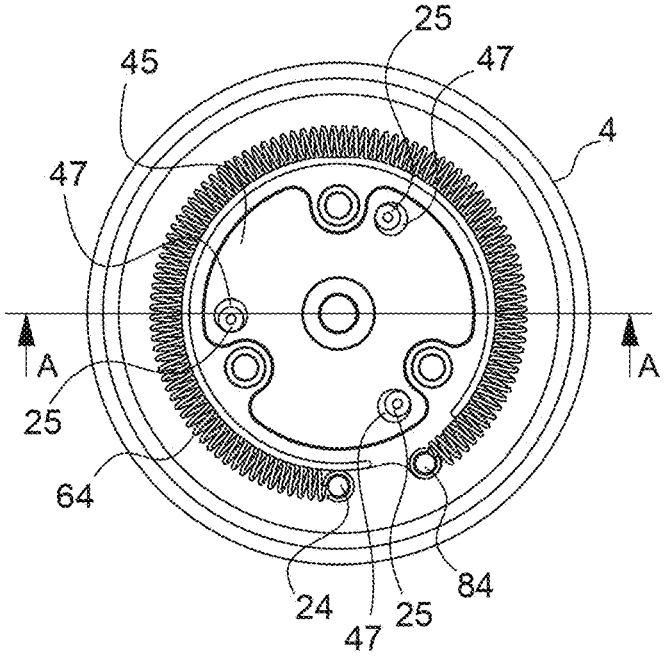
FIG. 19 is a similar view to that of FIG. 11, showing the passage from the locked configuration of the variant of the opening and closing device to its unlocked configuration.
Figure 19A:
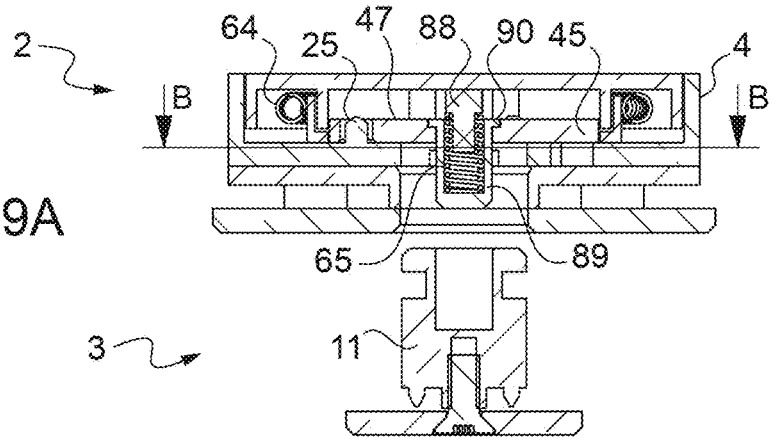
FIG. 19A is a similar view to that of FIG. 11A, showing the passage from the locked configuration of the variant of the opening and closing device to its unlocked configuration.
Figure 19B:
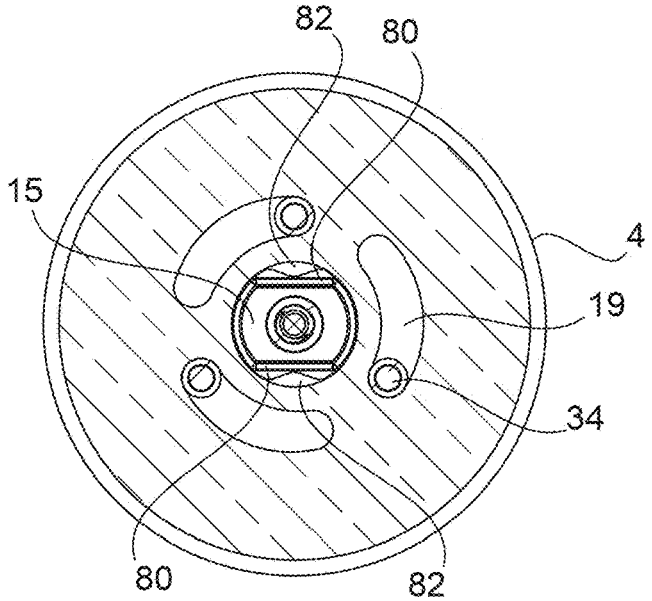
FIG. 19B is a similar view to that of FIG. 11B, showing the passage from the locked configuration of the variant of the opening and closing device to its unlocked configuration.

FIGS. 19, 19A and 19B show the opening and closing device 1 when the mechanism passes from its locked configuration to its unlocked configuration. The housing 4 is rotationally driven from its stable first position to its second position. The first return member 64 is placed in tension by the movement of the first attachment stem 24 of the housing 4 in relation to the second attachment stem 84 which remains fixed. The protrusions 25 of the housing 4 are also moved relative to the latch 45. These protrusions 25 slide against the inside face 50 of the latch 45 until they arrive adjacent the recesses 47 formed in the latch 45. The latch 45 is then translated within the clasp casing 2 by the action of the second return member 65 which relaxes. In particular, the latch 45 is driven by the collar 90 of the sleeving member 89. Furthermore, the movement of the housing 4 drives the movement of the teeth 82 relative to the flats 80 of the finger 11 of the assembly button 3. The flats 80 are then substantially aligned with the teeth 82 and the assembly button 3 can be released. The action of the second return member 65 on the latch 45 causes the latter to push the finger 11 of the assembly button 3 out of the clasp casing 2.

Figure 20:
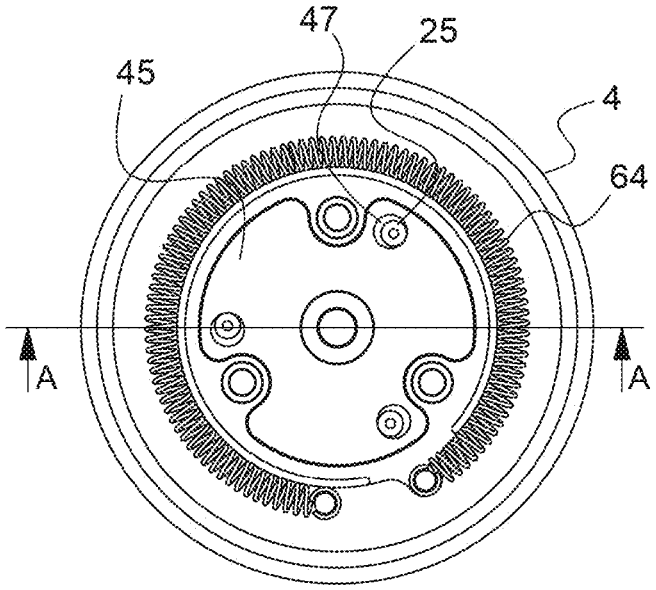
FIG. 20 is a similar view to that of FIG. 12, showing the variant of the opening and closing device in its unlocked configuration.
Figure 20A:
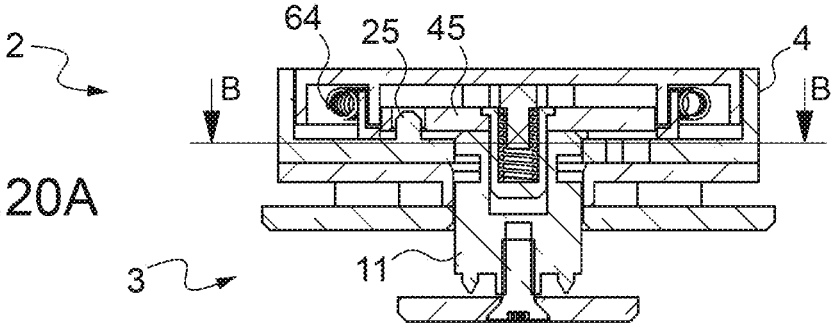
FIG. 20A is a similar view to that of FIG. 12A, showing the variant of the opening and closing device in its unlocked configuration.
Figure 20B:
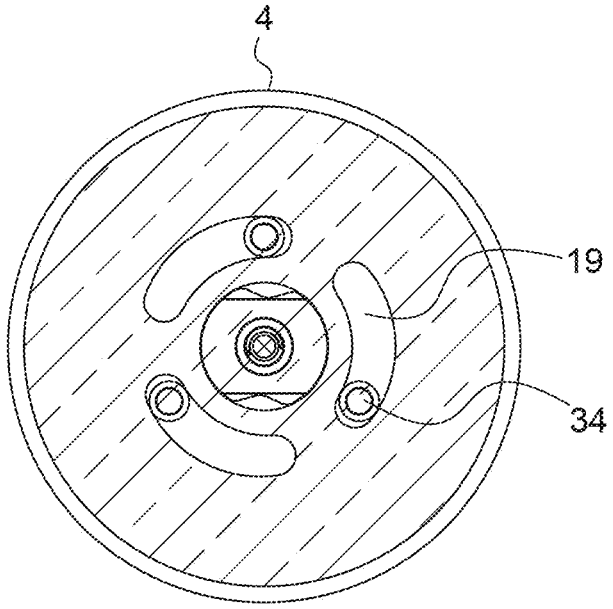
FIG. 20B is a similar view to that of FIG. 12B, showing the variant of the opening and closing device in its unlocked configuration.

FIGS. 20, 20A and 20B show the opening and closing device 1 when the mechanism passes from its unlocked configuration to its locked configuration. The finger 11 of the assembly button 3 is re-inserted into the clasp casing 2. The free end 15 of the finger 11 comes to bear against the inside face 50 of the latch 45 and pushes the latter against the second return member 65, which becomes compressed in the sleeving member 89. The latch 45 is then driven in translational movement towards the cover 5. The latch 45 thus moves apart from the housing 4 until the protrusions 25 of the housing 4 are made to come out of the recesses 47 of the latch 45. This withdrawal thus releases the housing 4, which is returned into its stable first position by the action of the first return member 64, putting the teeth 82 of the housing 4 back into a position substantially perpendicular to the flats 80 of the finger 11 of the assembly button 3, so as to lock the assembly button 3 in the clasp casing 2. The configuration of FIGS. 19, 19A and 19B is thus returned to.

The variant of the opening and closing device 1 is also particularly convenient in that it enables the article to be opened simply by rotating the housing 4, the assembly button 3 being automatically released from the clasp casing 2 by the action of the latch 45 and the mechanism thus being in unlocked configuration. Furthermore, the variant of the opening and closing device 1 is particularly convenient in that it enables the article to be closed simply by inserting the assembly button 3 into the clasp casing 2, without having to act upon the housing 4. As a matter of fact, the translation of the latch 45 when the housing 4 is rotationally driven from its stable first position to its second position makes it possible to maintain the housing 4 in its second position, in which the assembly button 3 can easily be withdrawn and/or inserted. Furthermore, since the housing 4 directly drives the teeth 82 that it comprises into a position in which they release the assembly button 3, the latter remains in that position and it can easily be withdrawn and/or re-inserted.

Variants not illustrated are presented below.

The forms of the holding members and complementary holding members may be different from those of the protrusions and recesses described and illustrated.

The forms of the blades and/or of the teeth may be different from those described and illustrated.

The first and second return members may be different from tension and compression springs.

It is possible for the device not to have a counter-plate fastened to the clasp casing.

It is possible for the device not to have a flange fastened to the assembly button.

More generally, it is recalled that the invention is not limited to the examples described and illustrated.

The invention claimed is:

1. A device for opening and closing an article, particularly of natural or artificial leather, comprising a clasp casing (2) and an assembly button (3) configured to cooperate with said clasp casing, which clasp casing is provided with a mechanism having a locked configuration in which said article can be closed and an unlocked configuration in which said article may be opened, wherein said mechanism comprises a housing (4) rotatably mounted relative to said clasp casing (2), between a stable first position and a second position, at least one locking member (60; 82) movably mounted in said clasp casing (2) and configured to be driven by said housing (4), and a latch (45) mounted movably with respect to translation in said clasp casing (2) and configured to cooperate with said housing (4) said mechanism being configured such that: when said housing (4) is in the stable first position and said assembly button (3) is inserted into said clasp casing (2), said at least one locking member (60; 82) immobilizes said assembly button (3) at least with respect to translation; when said housing (4) is caused to rotate and passes from the stable first position to the second position, said at least one locking member (60; 82) is displaced until said assembly button (3) is released and said latch (45) is translationally driven within said clasp casing (2) until said assembly button (3) is pushed out of said clasp casing (2); when said housing (4) is in the second position, said latch (45) immobilizes said housing (4) and said at least one locking member (60; 82); and when said assembly button (3) is re-inserted into said clasp casing (2), said assembly button (3) pushes said latch (45) which releases said housing (4) and said at least one locking member (60; 82), said housing (4) is caused to rotate and passes from the second position to the stable first position and said at least one locking member (60; 82) is displaced until said assembly button (3) is immobilized at least with respect to translation.

2. The device according to claim 1, wherein said housing (4) comprises a plurality of windows (19), said mechanism comprises a housing plate (7) provided with a plurality of chimneys (34) which extend from an inside face (33) of said housing plate (7) and which are received in said windows (19) of said housing (4), and said chimneys (34) are displaced within said windows (19) when said housing (4) is caused to rotate and passes from the stable first position to the second position, and vice-versa.

3. The device according to claim 2, wherein said mechanism comprises a first return member (64) configured to return said housing (4) to the stable first position, said first return member being formed by a tension spring.

4. The device according to claim 3, wherein said housing (4) comprises a complementary window (20), a first attachment stem (24) as well as an at least partly circular inside wall (21), said housing plate (7) is provided with a second attachment stem (36) which projects from said inside face (33) of said housing plate (7) and which is received in said complementary window (20) of said housing (4), and said first return member (64) is at least partly disposed along said inside wall (21) of said housing (4) and mechanically connected, by a first end, to said first attachment stem (24) and, by a second end which is an opposite end to said first end, to said attachment stem (36).

5. The device according to claim 3, wherein said housing (4) comprises a first attachment stem (24), said mechanism comprises a ring (81) housed in said housing, said ring is provided with an at least partly circular wall from which projects a second attachment stem (84) as well as mounting lugs (85) in which are received said chimneys (34) of said housing plate (7), and said first return member (64) is at least partly disposed along said wall of said ring (81) and mechanically connected, by a first end, to said first attachment stem (24) and, by a second end which is an opposite end to said first end, to said second attachment stem (84).

6. The device according to claim 2, wherein said housing (4) comprises a plurality of drive pins (27) which extend from an outside face (28) of said housing (4), towards said inside face (33) of said housing plate (7), said mechanism comprises a plurality of blades (60) forming such locking members, said blades (60) are pivotally mounted on said chimneys (34) of said housing plate (7) and are provided with cut-outs (62) in which are movably inserted said drive pins (27) of said housing (4), said assembly button (3) comprises a finger (11) provided with a circular groove (14), and when said housing (4) is in the stable first position, said blades (60) are at least partly accommodated in said groove (14) of said finger (11) thereby locking said assembly button (3) in said housing (4), whereas when said housing (4) is in the second position, said blades (60) are swiveled relative to said housing plate (7) by the action of said drive pins (27) of said housing (4) in said cut-outs (62) of said blades (60), said blades (60) are at a distance from said groove (14) of said finger (11) and said assembly button (3) may be released.

7. The device according to claim 6, wherein said assembly button (3) comprises a flange (12) mechanically connected to said finger (11) at an opposite end to said circular groove (14).

8. The device according to claim 7, wherein a space (13) is provided between said flange (12) and said finger (11) to interpose therein a first portion of said article, particularly of natural or artificial leather, for the connection of said assembly button (3) to said article.

9. The device according to claim 1, wherein said housing (4) comprises a central through-opening (18), teeth (82) which project into said central opening (18) and which form such said locking members, said assembly button (3) comprises a finger (11) provided with a circular groove (14) and flats (80) formed at a free end (15) of said finger (11), and when said housing (4) is in the stable first position, said teeth (82) of said housing (4) are at least partly accommodated in said groove (14) of said finger (11) and said flats (80) of said finger (11) are disposed substantially perpendicularly to said teeth (82) thereby locking said assembly button (3) in said housing (4), whereas when said housing (4) is in the second position, said flats (80) are substantially aligned with said teeth (82) and said assembly button (3) can be released.

10. The device according to claim 1, wherein said mechanism further comprises a cover (5) relative to which said housing (4) is able to rotate, said latch (45) is mounted on said cover (5) and rotationally coupled relative to the latter, said latch (45) is provided with at least one holding member and said housing (4) is provided with at least one complementary holding member (25) configured to cooperate with said at least one holding member of said latch (45) when said housing (4) is in the second position, to immobilize said housing (4) and said at least one locking member (60; 82).

11. The device according to claim 10, wherein said cover (5) is provided with a plurality of chimneys (31) which extend from an inside face (30) of said cover (5) and said latch (45) has the general form of a plate in which are provided notches (46) receiving said chimneys (31) of said cover (5) to immobilize the latter rotationally relative to said cover (5).

12. The device according to claim 10, wherein said latch (45) is provided with at least one recess (47) forming said at least one holding member and said housing (4) is provided with at least one protrusion (25) projecting from an inside face (22) of said housing (4) and forming said at least one complementary holding member.

13. The device according to claim 12, wherein said mechanism is configured in order for said at least one protrusion (25) of said housing (4) to come into abutment against an edge of said at least one recess (47) of said latch (45), or is inserted into said at least one recess (47) of said latch (45), when said housing (4) is in the second position.

14. The device according to claim 12, wherein said latch (45) is furthermore provided with at least one shoulder (48) provided in a plate forming said latch (45), so as to form at least one said recess (47) which is progressive in the sense that it makes it possible to progressively hold said housing (4) in the stable first position.

15. The device according to claim 10, wherein said mechanism further comprises a second return member (65) configured to make said latch (45) bear against said housing (4) when not acted upon externally, said second return member being formed by a compression spring.

16. The device according to claim 15, wherein said cover (5) is provided with a seat (32) formed in the inside face (30) and partially housing said second return member (65).

17. The device according to claim 15, wherein said mechanism comprises a support pin (88) having a base disposed against an inside face (30) of said cover (5) and a stem on which is mounted said second return member (65), said mechanism further comprises a sleeving member (89) provided with an internal space into which is inserted said second return member (65) mounted on said support pin (88) and provided with an outside collar (90), and said latch (45) is provided with an aperture (87) and is slidingly mounted on said sleeving member (89), said outside collar (90) of said sleeving member (89) coming to bear against a face (49) of said latch (45) facing opposite said inside face (30) of said cover (5).

18. The device according to claim 1, wherein said housing (4) is rotatably mounted between a housing plate (7) and a cover (5), which are mechanically connected to each other, using fastening screws (67).

19. The device according to claim 1, wherein said mechanism comprises a housing plate (7) relative to which said housing (4) is able to rotate, said housing plate (7) is provided with a low wall (39) which is at least partly circular, and said clasp casing (2) further comprises a counter-plate (8) mechanically connected to said housing plate (7) and disposed against said low wall (39) so as to provide a space (10) between said housing plate (7) and said counter-plate (8), to interpose therein a second portion of said article, particularly of natural or artificial leather, for the connection of said clasp casing (2) to said article.

20. An article, particularly of natural or artificial leather, comprising an opening and closing device (1) according to claim 1, a first portion on which is fastened said assembly button (3) of said opening and closing device (1), and a second portion on which is fastened said clasp casing (2) of said opening and closing device (1), said opening and closing device (1) being configured to receive and immobilize said assembly button (3) in said clasp casing (2) in said locked configuration of said mechanism of said opening and closing device (1), and to release said assembly button (3) from said clasp casing (2) in said unlocked configuration of said mechanism.

* * * * *